US005566518A

United States Patent [19]

Martin et al.

[11] Patent Number: 5,566,518

[45] Date of Patent: Oct. 22, 1996

[54] CONCRETE FORMING SYSTEM WITH BRACE TIES

[75] Inventors: Lynn E. Martin, Paola, Kans.; Jay D. Williamson, Papillion, Nebr.; Kenneth M. Blom, Kansas City, Mo.; Jamieson Vaughan; Charles S. Smith, both of Omaha, Nebr.

[73] Assignee: I.S.M., Inc., Paola, Kans.

[21] Appl. No.: 334,279

[22] Filed: Nov. 4, 1994

[51] Int. Cl.[6] ..... E04B 2/00

[52] U.S. Cl. ..... 52/426; 52/439; 52/438; 52/562; 52/564; 52/568; 52/309.17

[58] Field of Search ..... 52/442, 426, 427, 52/438, 439, 562, 564, 565, 568, 309.15, 309.17

[56] References Cited

U.S. PATENT DOCUMENTS

| | | | |
|---|---|---|---|
| 836,589 | 11/1906 | Layfield et al. . | |
| 880,820 | 3/1908 | Pierson . | |
| 1,226,214 | 5/1917 | Hopkins | 52/568 X |
| 1,871,318 | 8/1932 | Greenwood . | |
| 2,442,962 | 6/1948 | Rumble | 52/564 X |
| 3,778,020 | 12/1973 | Burrows et al. . | |
| 3,788,020 | 1/1974 | Gregori . | |
| 3,872,636 | 3/1975 | Nicosia . | |
| 3,902,296 | 9/1975 | Thomas | 52/426 X |
| 3,922,828 | 12/1975 | Patton . | |
| 3,979,867 | 9/1976 | Sowinski . | |
| 4,223,501 | 9/1980 | DeLozier . | |
| 4,516,372 | 5/1985 | Grutsch . | |
| 4,698,947 | 10/1987 | McKay . | |
| 4,703,602 | 11/1987 | Pardo | 52/427 X |
| 4,706,429 | 11/1987 | Young . | |
| 4,730,422 | 3/1988 | Young . | |
| 4,731,968 | 3/1988 | Obino . | |
| 4,750,308 | 6/1988 | McKay . | |
| 4,765,109 | 8/1988 | Boeshart . | |
| 4,879,855 | 11/1989 | Berrenberg . | |
| 4,884,382 | 12/1989 | Horbin | 52/426 |
| 4,889,310 | 12/1989 | Boeshart . | |
| 5,056,289 | 10/1991 | Colen | 52/564 |
| 5,065,561 | 11/1991 | Mason | 52/426 X |
| 5,107,648 | 4/1992 | Roby | 52/426 X |
| 5,390,459 | 2/1995 | Mensen | 52/426 |

*Primary Examiner*—Wynn E. Wood
*Attorney, Agent, or Firm*—Chase & Yakimo

[57] ABSTRACT

A concrete form tie comprises a pair of laterally displaced sidewall support assemblies with a reinforcing web extending therebetween. The support assemblies bite into the exterior sidewall surfaces as positioned thereat by the web transversely extending between the support assemblies. The web comprises a pair of brackets as formed by a support strut extending through a notch at the top of the form sidewall with a hanger element depending therefrom. A bridge extends between the depending hangers and across a vertical cavity formed between the sidewalls. The tie resists pressures acting on the sidewalls to preclude blow out along the horizontal joints of form courses as well as lateral displacement of the sidewalls. A starter tie is disclosed for respectively securing the lower end of the first course of sidewalls to a footing. A finish tie is disclosed for maintaining the displacement of the sidewalls of the top course of forms.

17 Claims, 6 Drawing Sheets

CONCRETE FORMING SYSTEM WITH BRACE TIES

BACKGROUND OF THE INVENTION

This invention relates to a concrete forming system and, more particularly, to a brace tie for maintaining the sidewalls of a concrete form in a desired laterally spaced-apart relationship.

Concrete forms made of a polymeric foam material are known. One such form is shown in U.S. Pat. No. 3,788,020, issued on Jan. 29, 1974. This patent discloses a concrete form with a pair of sidewalls, end walls and intermediate partition walls. A plurality of these forms are assembled to present vertical cavities for pouring concrete therein to form a plurality of vertical concrete columns or piers. These vertical columns are connected by a horizontal concrete beam formed by filling a channel with concrete, the channel presented upon placing one row of concrete forms atop another.

One problem with these concrete forms is that the sidewalls must be immobilized so as to resist pressures on the walls during concrete pouring and curing. If not, the form sidewalls will separate along the joints respectively presented along the zones of connection between longitudinally and vertically adjacent forms. If not sufficiently braced the concrete can cause these joints to separate. The industry refers to such separations as "blow outs".

Accordingly, various devices in the forms of braces and permanent tension members have been proposed so as to maintain the sidewalls in place to preclude such "blow outs" during concrete pouring and subsequent curing. However, such devices have been relatively complex in construction requiring the sidewalls to have special configurations so as to receive the braces and/or ties.

In response thereto we have invented a novel tie for concrete forms which effectively interfaces with the form sidewalls so as to maintain the walls in place during concrete pouring and curing. Our tie generally comprises first and second pairs of upper and lower support plates designed to bite into the exterior surfaces of the form sidewalls. A web connects the flanges in extension across the space between the sidewalls. Upon concrete pouring and curing the web and plates resist movement of the form sidewalls. The tie allows for easy on-site installation and use.

It is therefore a general object of this invention to provide a novel concrete form tie for use in a concrete forming system.

A further object of this invention is to provide a concrete form tie, as aforesaid, which is adaptable for use with forms of various constructions.

A further object of this invention is to provide a concrete form tie, as aforesaid, which diminishes the displacement of adjacent sidewalls of a concrete form and separation of joints along adjacent forms.

A still more particular object of this invention is to provide a concrete form tie, as aforesaid, which presents a reinforcing web spanning the form sidewalls.

Another particular object of this invention is to provide a concrete form tie, as aforesaid, which is easily installed on site and does not interfere with form assembly.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 1:
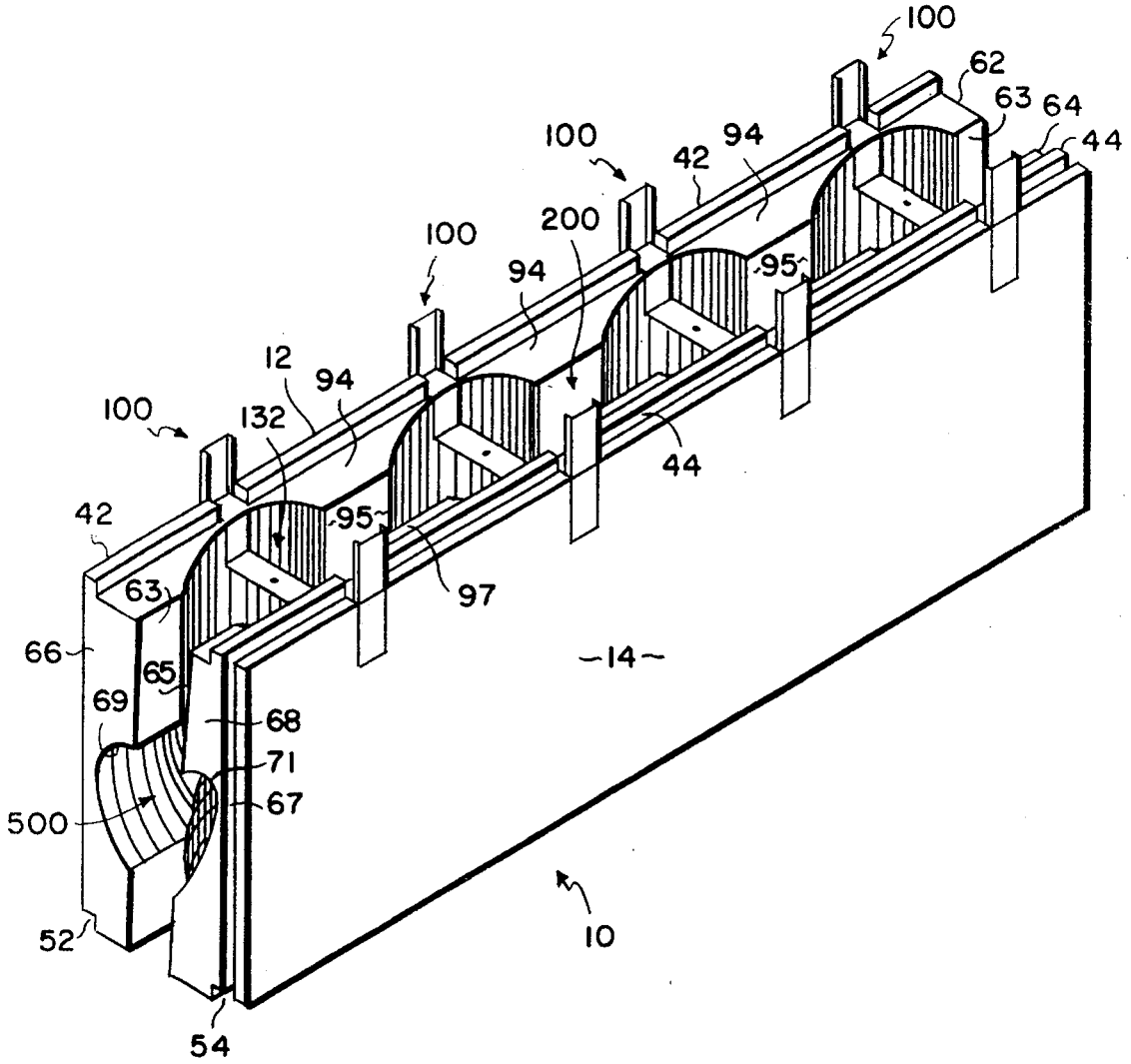
FIG. 1 is a perspective view of a plurality of concrete form ties spanning first and second sidewalls of a concrete form.
Figure 2:
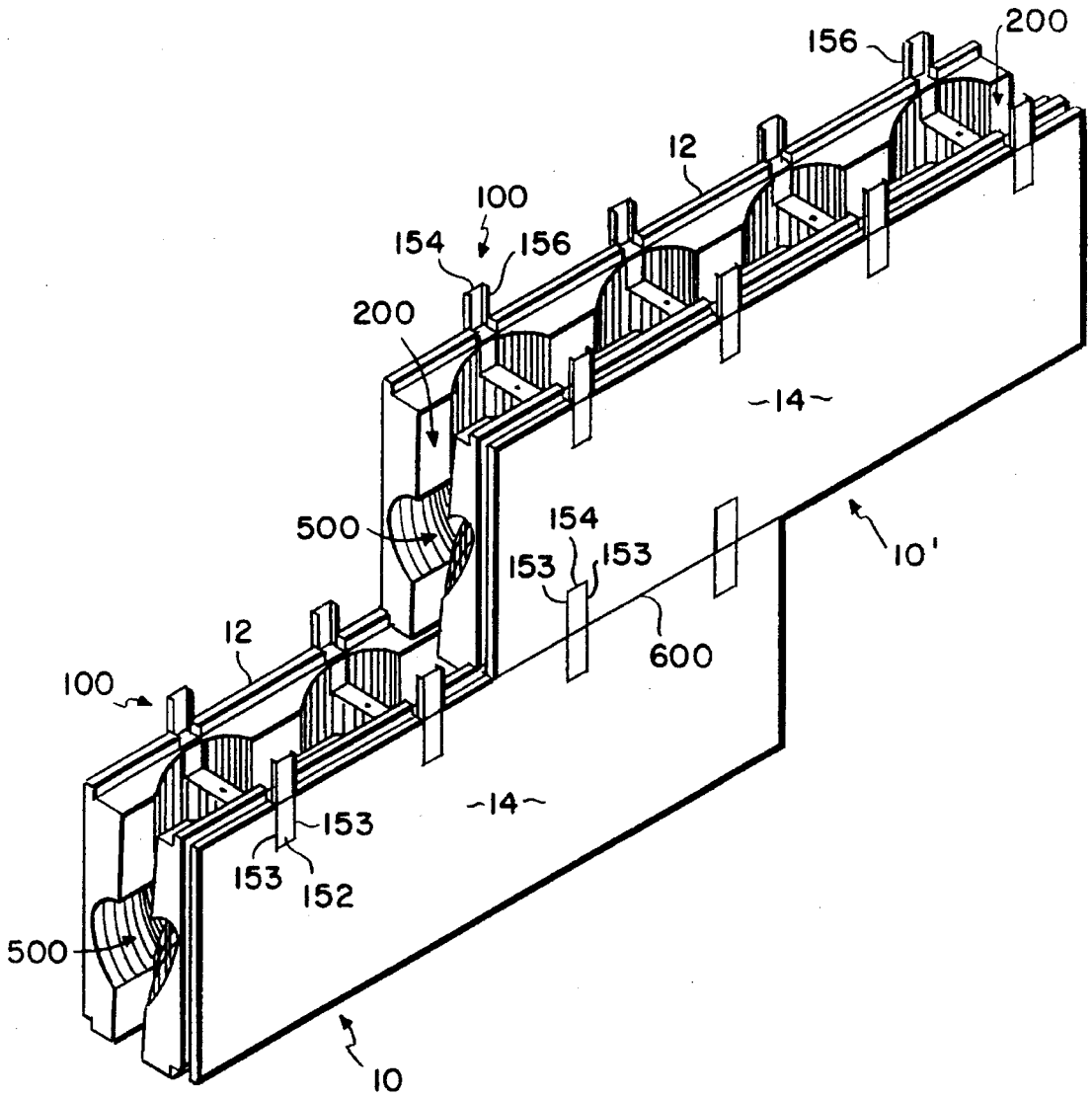
FIG. 2 is a perspective view of two concrete forms placed in a longitudinally displaced, over/under relationship with concrete form ties being utilized therewith.
Figure 3:
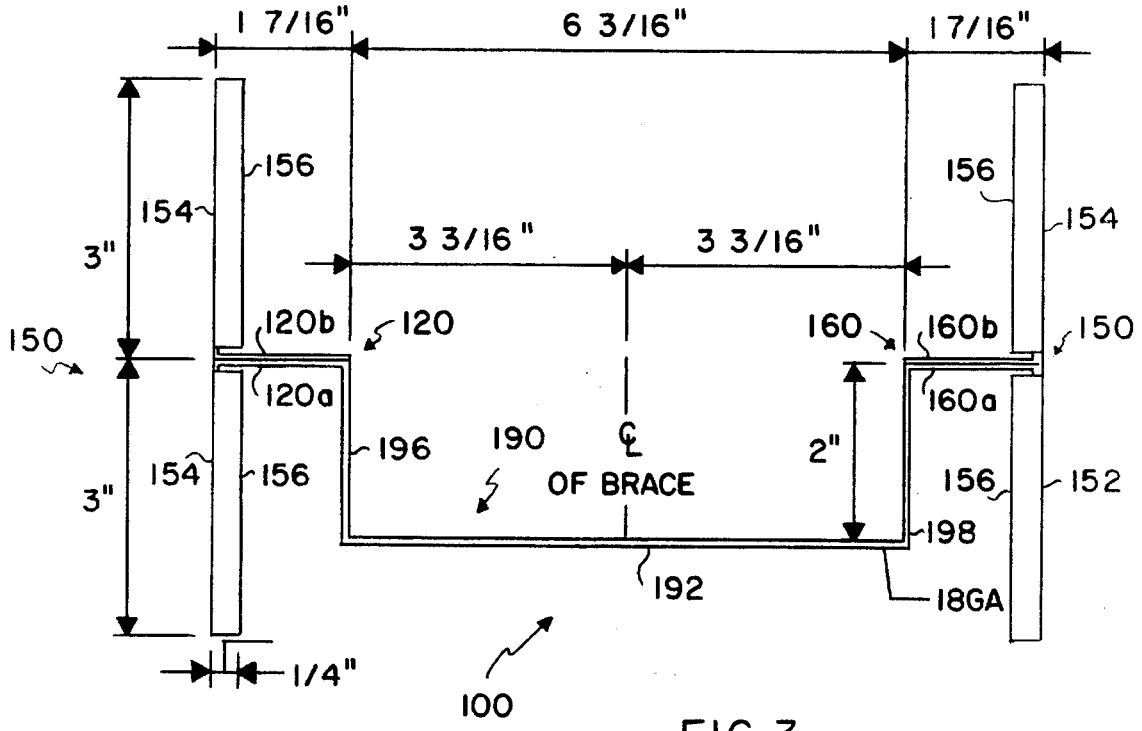
FIG. 3 is a side view of a concrete form tie utilized in FIG. 1 on an enlarged scale.
Figure 4:
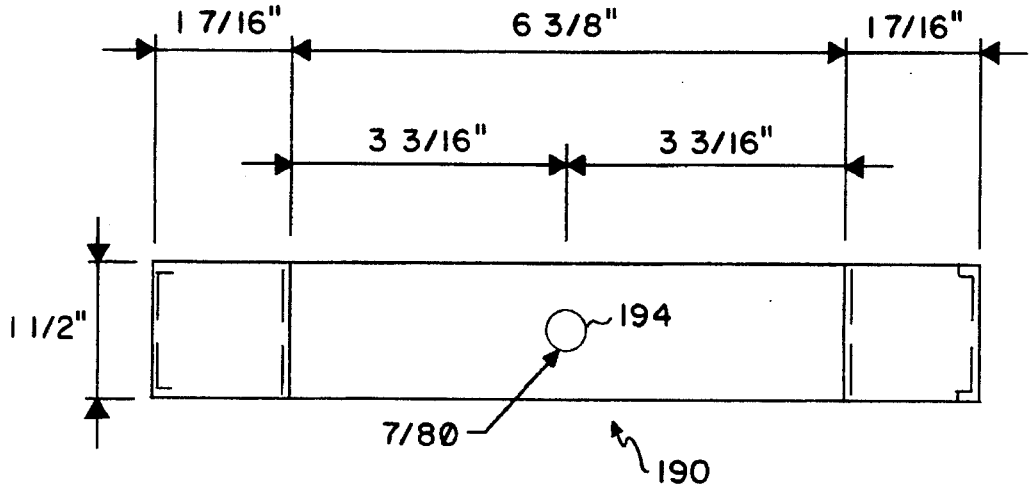
FIG. 4 is a top view of the concrete form tie of FIG. 3.

Turning more particularly to the drawings, FIGS. 1 and 2 illustrate the form ties 100 connecting a pair of sidewalls 12, 14 of a foam concrete form 10. FIG. 2 illustrates a pair of forms 10, 10' connected in a longitudinally displaced, over/under relationship. It is understood that FIGS. 1 and 2 show the use of one particular type of concrete form 10. This form 10 is believed to be the subject of a pending patent application. Other types of forms may be utilized with the ties 100.

As shown each concrete form 10 comprises a pair of laterally spaced apart sidewalls 12, 14. Positioned at the top edges of each side wall 12, 14 are first and second flanges presenting tongue elements 42, 44 of a tongue/groove connection. Complementary grooves 52, 54 longitudinally extend along the bottom edges of each respective side wall 12, 14. As such the respective tongues 42, 44 of an underlying form mate with the complementary grooves 52, 54 of an overlying form 10 as shown in FIG. 2.

At one end of each form 10 the respective sidewalls 12, 14 extend beyond the end walls 62, 64. At the opposed end the respective end walls 66, 68 extend beyond the adjacent sidewalls 12, 14. Accordingly, the respective extensions of the sidewalls are designed to overlap the extensions 67 of the end walls of a longitudinally adjacent form 10. Thus, adjacent concrete forms 10 are connected by a vertical lap joint interface. Alternatively, vertically extending tongues and grooves can be used along the opposed ends of each form for joinder with complementary grooves or tongues of adjacent forms 10 in a tongue/groove connection.

At the opposed ends of each form 10 are a pair of end walls 62, 64, 66, 68 laterally extending from the respective sidewalls one towards the other. Each end wall presents longitudinally extending walls 63, 65 facing one another with slot 200 therebetween. An arcuate notch or bore 69, 71 extends through each end wall 63, 65. Upon placing the form sidewalls 12, 14 in their laterally spaced-apart relationship, the respective notches/bores 69, 71 are aligned and define apertures of a horizontal channel which extends through the respective end walls.

Longitudinally spaced from the end walls are a plurality of opposed partition walls 94. These spaced apart partition walls 94 laterally extend from each sidewall 12, 14 towards each other and present longitudinally extending walls 95, 97 facing one another with slot 200 therebetween. The partition walls 94 cooperate with the adjacent end walls and each other to form a plurality of vertical cavities 132 extending through the concrete form 10. Each partition wall 94 includes arcuate notches/bores aligned with the notches 69, 71 in the opposed, end walls. As such, a channel 500 now extends through these intermediate partition walls 94 and between the vertical cavities 132 which are longitudinally displaced throughout the length of the form.

In use a first row of the forms 10 are secured to a footing or the like (not shown) such that the form sidewalls 12, 14 are in a desired laterally spaced-apart relationship. Conventional means may be used to secure this first row of form sidewalls 12, 14 to such footing including insertion of the forms into a wet footing and allowing the footing to dry.

Figure 5:
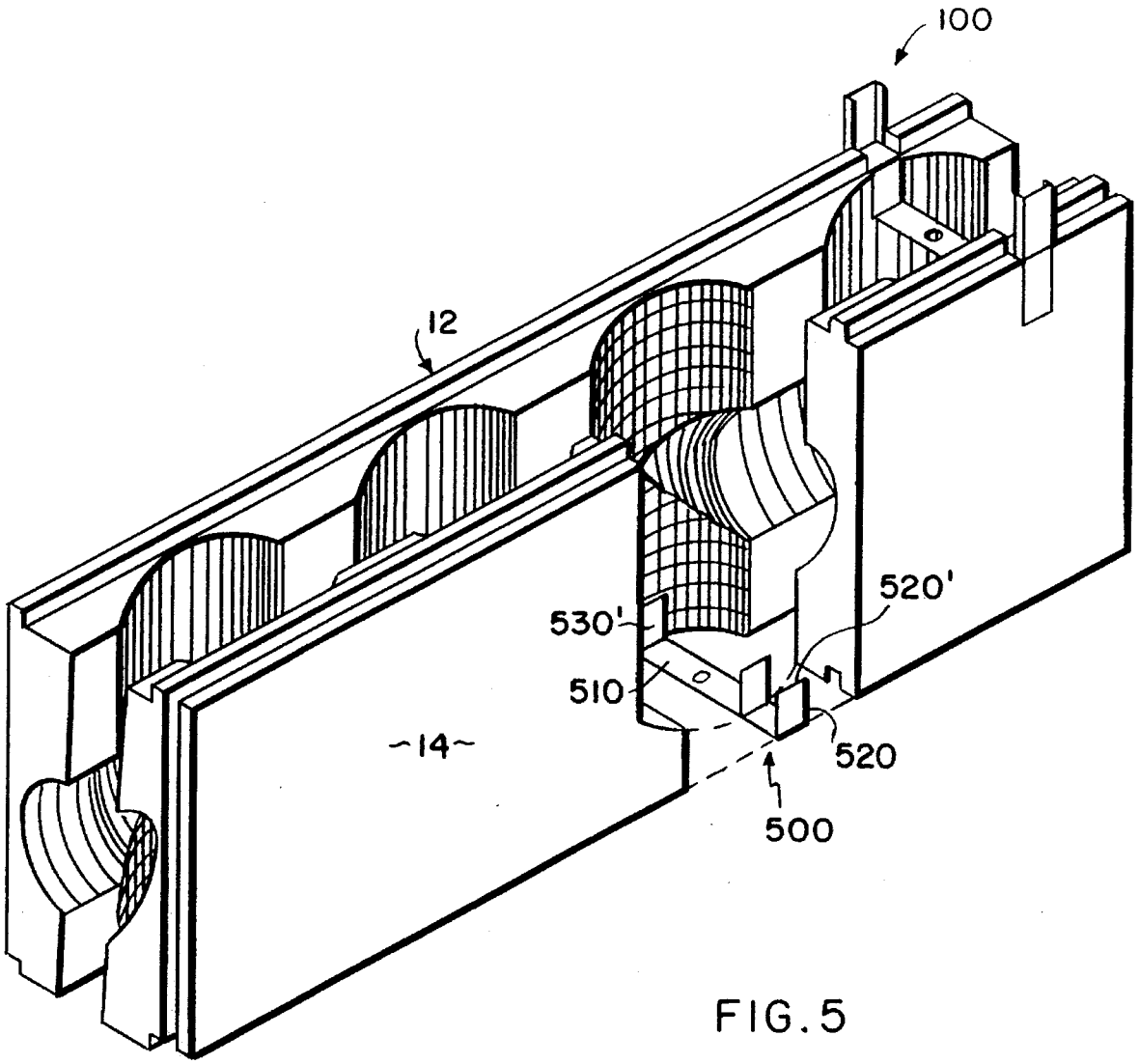
FIG. 5 is a perspective view of a concrete form with a portion of a sidewall broken away to show a starter tie.

Alternatively, a starter tie 500 may be secured to the footing (FIG. 5). The tie 500 includes a horizontal web 510 having first and second pairs of vertical flanges 520, 520', 530, 530' extending therefrom. The flanges 520, 520', 530, 530' receive the lower portion of the respective sidewalls 12, 14 such that the flanges 520, 530 bear against the exterior surface of the respective sidewalls. The laterally displaced flanges 520', 530' bear against the interior side of the sidewall preferably against the surface of the vertical cavity 132.

As previously discussed, the ends of longitudinally adjacent forms 10 are connected by the above-discussed lap joint interface or by an alternative tongue and groove connection.

To maintain the laterally spaced-apart relationship of the sidewalls 12, 14 during subsequent form assembly a plurality of concrete ties 100 are utilized.

Each tie 100 generally comprises a pair of horizontal, laterally extending support brackets/struts 120, 160 positioned at the lateral ends of a web 190. The web 190 generally comprises a flat plate 192 spanning a pair of hanger elements 196, 198 depending from the struts 120, 160. The lower portion **120*a*, 160*a* of support struts 120, 160, hangers 196, 198 and web 192** may be formed of one piece of metal, if desired.

At the end of each support strut 120, 160 is positioned a vertical sidewall support assembly 150. Each assembly 150 comprises lower and upper vertically extending flanges 152, 154. The upper support flanges 152 utilize struts **120*b*, 160*b* which are attached to the struts 120*a*, 160 of the lower support flanges 152. The support flanges 152, 154 are generally rectangular plates having lips 156 extending from the vertical edges 153** of each plate.

During the molding of the forms 10 a plurality of opposed notches 60 are formed in the tongue elements 42, 44. Alternatively, during the assembly of the vertical courses of the forms 10, 10', the tongue elements 42, 44 along the upper extent of each sidewall 12, 14 may be notched 60 on site so as to transversely receive the respective support arms 120, 160 therein.

Depending hanger portions 196, 198, adjacent the cavity 134 surface, position the web/bridge 190 within the vertical cavity 134 so as to preclude web 190 interference with the assembly of vertical courses of forms 10. Accordingly, it can be seen that the strut **120*b*, 160*b*/hanger 198 combinations act as brackets so as to hang the web 190 between the sidewalls 12, 14. Concurrently, the lips 156 of the lower support flanges/plates 152 are embedded/bite into the exterior foam surface of each sidewall 12, 14 such that the flange plate lies generally flush with the foam sidewall 12, 14. A plurality of ties 100 are so positioned between the sidewalls 12, 14. A central aperture 194 in the web 192 of each tie 100 allows for extension of vertical rebar therethrough. Conventional rebar (not shown) is then extended from the footing through each vertical cavity 134 of each form 10 and through the central apertures 194 of ties 100. Horizontal rebar is tied to the vertical rebar for extension along the horizontal bore 500**.

Upon placement of the upper form 10' atop a lower form 10, the complementary grooves 52, 54 of the upper form 10 mate with the underlying tongues 42, 44 and close the previously formed notches 60. The lips 156 of the upper flange plates 154 are embedded into the sidewall 12, 14 of the upper form 10'. Accordingly, each sidewall support assembly 150 spans the horizontal joint 600 of vertically adjacent forms 10, 10' to offer reinforcing support thereto. The engagement of concrete form ties 100 is repeated along the longitudinal extent of each form 10. It is understood that at the top edge of the upper course of the forms 10 the upper vertical plates 154 are not utilized. Accordingly, alternative ties may be manufactured in which the upper flange plate 154 with support arm/strut **120*b*, 160*b* is not attached to support arms 120*a*, 160*a***.

Figure 6:
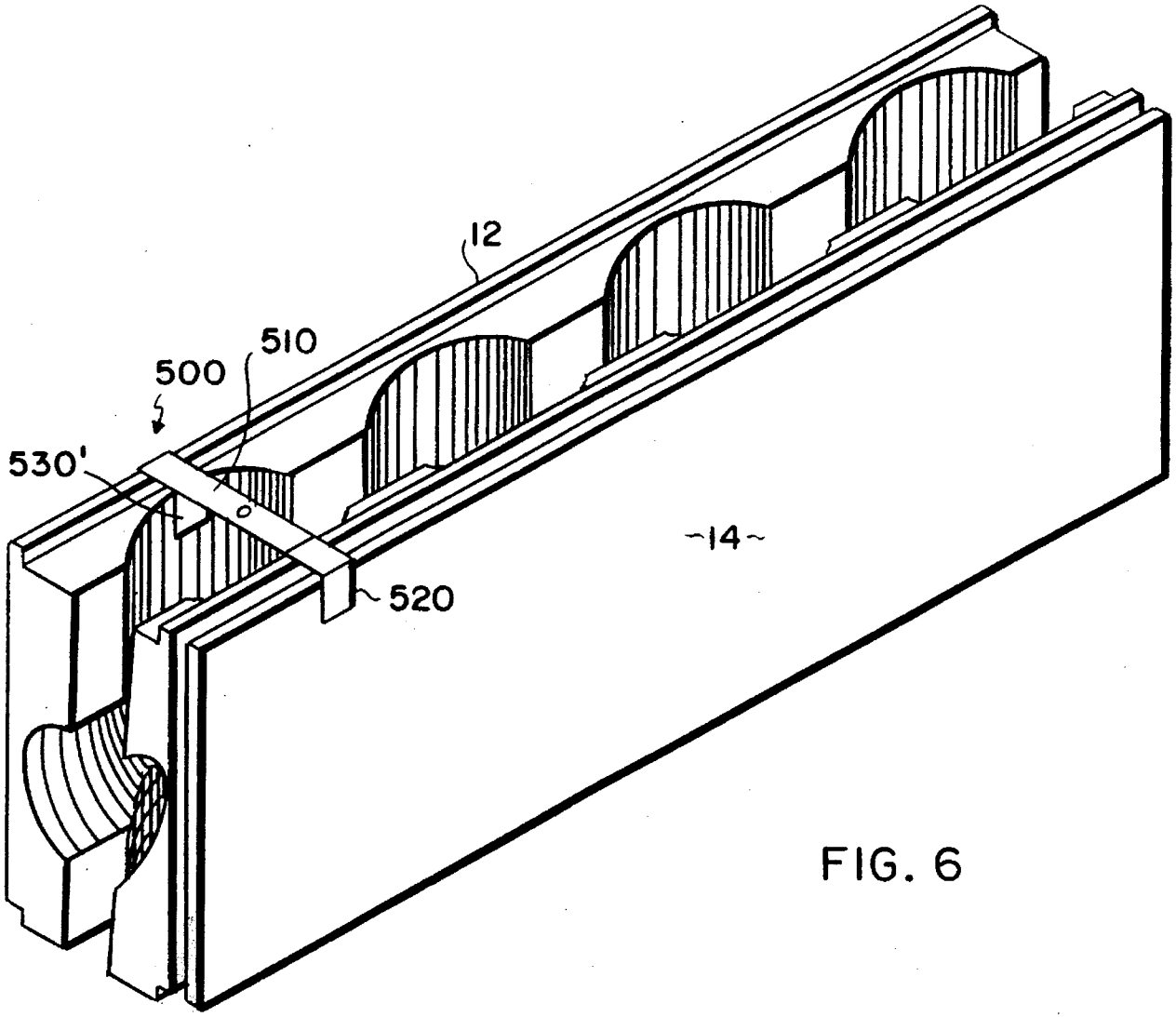
FIG. 6 is a perspective view of a concrete form showing the configuration and use of a top tie.
Figure 8:
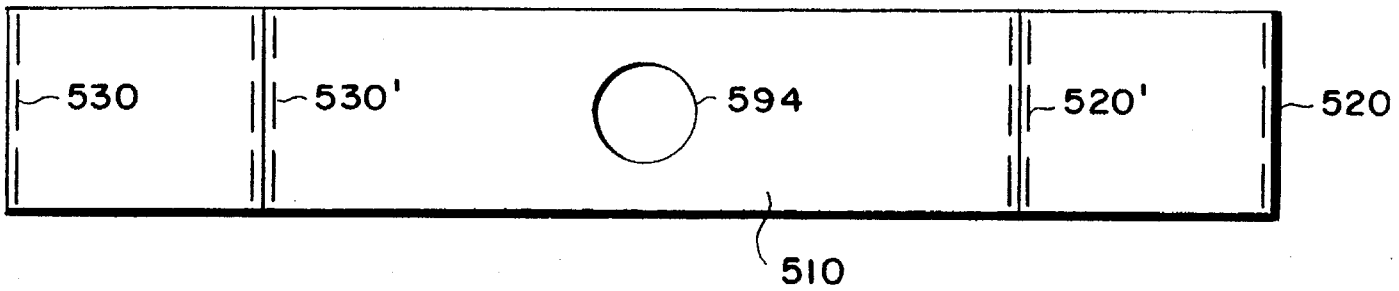
FIG. 8 is a bottom view of the tie of FIG. 7.
Figure 7:
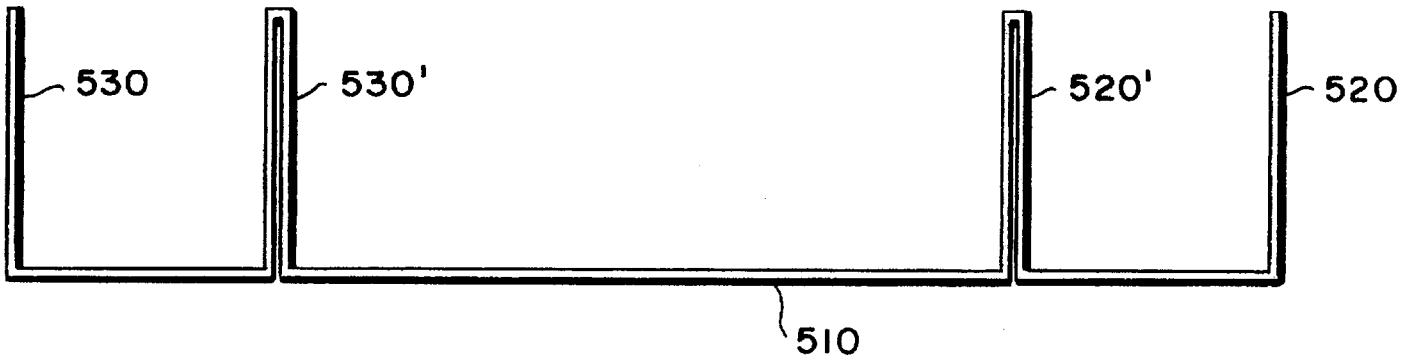
FIG. 7 is a plan view, on an enlarged scale, showing a starter tie.

Alternatively, the starter ties 500 may be utilized. As shown in FIG. 6, the above-described starter tie 500 is rotated such that the now depending flanges 520, 530 bear on the exterior surface of the sidewalls 12, 14 with the interior flanges 520'530' bearing against the interior surface of the respective cavity 132 at the top end thereof. Aperture 594 allows for extension of vertical rebar therethrough.

The respective cavities 134 are then filled with concrete. It is understood that no more than four courses should be filled at one time. Also, the ends of each course may be fitted with bulkheads to preclude the concrete from discharge through the bore aperture. Such bulkheads may also include door framing, window framing or the like. It is also understood that the forms 10 may be cut so as to provide corners. (The use of bulk heads, bucks and corner sections is known to those working with prior foam forms.) The poured concrete will also flow into the vertical slot presented between the end walls and partition walls and horizontal bore. Upon filling the course(s) of forms to the top, a generally vertical concrete wall is formed. This wall extends between the vertical concrete columns or piers formed in cavities 134. Centrally extending through the vertical concrete wall and connecting the vertical concrete columns is a horizontal beam of concrete as formed within the channel 500.

Upon connection of a second course of forms 10' atop the first course of forms by means of the above-discussed lower tongue 42, 44/upper groove 52, 54 connections, the upper forms are longitudinally shifted relative to the first course of form. This displacement precludes the formation of a continuous, vertical joint extending between form courses. The vertical cavities in the upper course of forms are aligned with the lower vertical cavities. Again, the adjacent forms of each second course of concrete forms are connected by a lap joint interface. The poured concrete fills the respective cavities of this second course of forms. Additional form courses are connected and filled until the desired wall height is obtained.

Upon curing, a central, horizontal beam of concrete extends through the vertical wall formed by slot 200 and between the vertical piers 132. Embedded in each concrete column is the transverse web 190 of each tie 100.

The above-described form ties 100 presents a bracing structure which spans the horizontal joint 600 so as to diminish the probability of "blow out" at these horizontal joints 600. Also, the plates 152 and/or 154, struts 120, 160, hangers 196, 198 and web or bridge 192 cooperate to resist forces acting thereon and on the sidewalls 12, 14 during concrete pouring. The resistance precludes the lateral displacement of the form 10 sidewalls 12, 14 during concrete pouring and curing. Moreover, as the sidewalls 12, 14 need not be attached with permanent braces installed during the molding process,the form sidewalls 12, 14 can be easily transported, installed and adapted for on-site use. Finally, the plates 152, 154 can also be used as nailing surfaces for affixing exterior siding thereto.

It is to be understood that the dimensions shown in the figures are for purposes of illustration and not limitation. Moreover, while certain embodiments of this invention have been illustrated and described, they are not to be limited thereto except insofar as such limitations are included in the following claims and allowable functional equivalents thereof.

Having thus described the invention, what is claimed as new and desired to be secured by Letters Patent is as follows:

1. In combination with a concrete form, a form tie maintaining a lateral displacement between a pair of sidewalls of the concrete form comprising:

a support assembly engaging with an exterior surface of each sidewall, each support assembly comprising:
at least a lower support plate;
means on each support plate engaging the form sidewall adjacent said plate;

a web connecting said support assemblies, said web comprising:
a horizontal strut extending across a top edge of a respective form sidewall, each strut connected to at least said lower support plate of a respective support assembly;
a hanger depending from each strut and into a cavity presented between the laterally displaced sidewalls of the form;
a bridge spanning said hangers in extension between the sidewalls.

2. The combination as claimed in claim 1 wherein the form sidewall further comprises a longitudinal mating element along a top edge of each sidewall, each mating element of one of the sidewalls having at least one notch therein in alignment with a notch in the mating element in the other of the sidewalls, wherein said respective struts of said web extend through said respective notches to preclude interference with a mating engagement of the mating elements.

3. The combination as claimed in claim 2 wherein each hanger depends adjacent an interior surface of a respective sidewall.

4. The combination as claimed in claim 1 wherein said bridge laterally extends between an interior surface of each sidewall.

5. The combination as claimed in claim 2 wherein each strut comprises a generally flat plate.

6. The combination as claimed in claim 5 wherein each of said hangers is normal to each of said plates.

7. The combination as claimed in claim 6 wherein said bridge comprises a generally flat plate.

8. The combination as claimed in claim 7 further comprising an aperture in said bridge for passage of reinforcing rebar therethrough.

9. The combination as claimed in claim 1 further comprising:

an upper support plate connected to each of said struts; means on each upper support plate for engaging a respective sidewall of a second form placed atop the first form, whereupon said lower and upper support plates respectively engage sidewalls of lower and upper forms.

10. The combination as claimed in claim 1 wherein said engaging means comprises a lip extending from each plate for insertion into the form sidewall.

11. The combination as claimed in claim 9 wherein said upper support plate engaging means further comprises a lip extending from each upper support plate for insertion into the respective form sidewall.

12. In combination with an upper and lower concrete form, a form tie extending between a pair of laterally displaced sidewalls of said lower and upper concrete forms, the forms attached one atop the other comprising:

a pair of support assemblies engaging with each exterior surface of the laterally displaced sidewalls of an form, each support assembly comprising:
a lower support plate for the lower form;
an upper support plate for the upper form; means on each support plate engaging a sidewall of the form adjacent said plate;

bracket means mounting said support assemblies adjacent the respective sidewalls of the forms, said bracket means releasably engageable with a top edge of each of the lower form sidewalls and comprising:
a strut extending from each of said lower and upper support plates and configured to extend across a top edge of the respective sidewall of the lower form;
a hanger depending from each of said struts and below the top edge of the respective sidewall; a bridge extending between the depending hangers in extension between the sidewalls of the forms.

13. The combination as claimed in claim 12 wherein said engaging means comprises a lip extending from each plate and into the sidewall.

14. The combination as claimed in claim 12 wherein each strut extends through a notch in the top edge of the sidewall.

15. A concrete forming system comprising:

a first concrete form having a pair of laterally displaced sidewalls;

a mating element along a top edge of each of said form sidewalls;

a second concrete form having a pair of laterally displaced sidewalls;

a complementary mating element along a lower edge of said sidewalls of said second form for engagement with said mating element of said first form;

a plurality of aligned notches in each of said mating elements along the an edge of the form sidewalls;

a form tie comprising:
a pair of support assemblies for engagement at each pair of aligned notches, each support assembly comprising:
a lower support plate for each sidewall of the first form;
an upper support plate for each sidewall of the second form;
means on each support plate for holding said plate in a flush relationship with the sidewall;
a pair of horizontal struts for extension through the aligned notches at a top edge of the first form sidewalls, each strut connected at one end to one of said support plates and having an opposed end extending into a space between the laterally displaced sidewalls;
a hanger depending from said opposed end of each strut and presenting a lower end between the sidewalls of the first concrete form;
a bridge extending between said lower ends of said hangers.

16. The combination as claimed in claim 1 wherein said engaging means on said lower support plate comprises a lip extending from said lower support plate for insertion into the adjacent form sidewall.

17. The combination as claimed in claim 11 wherein said engaging means on said lower support plate further comprises a lip extending from each lower support plate for insertion into the adjacent form sidewall.

* * * * *